United States Patent [19]

Marincic et al.

[11] Patent Number: 5,038,169

[45] Date of Patent: Aug. 6, 1991

[54] PLURAL MODE PRINTER USER INTERFACE TERMINAL

[75] Inventors: Emil M. Marincic, Rochester, N.Y.; Glenn A. Laurent, Glenmoore, Pa.; Thomas E. Sollitt, Fairport, N.Y.; Dennis W. Berman, Victor, N.Y.; Carroll N. Bright, Walworth, N.Y.; DeWayne L. McCulley, Penfield, N.Y.; Fredrick J. Morton, Williamson, N.Y.

[73] Assignee: Xerox Corporation, Stamford, Conn.

[21] Appl. No.: 590,097

[22] Filed: Sep. 28, 1990

[51] Int. Cl.[5] ..... G03G 15/00

[52] U.S. Cl. ..... 355/200; 355/133; 248/285; 248/298; 248/917

[58] Field of Search ..... 355/200, 202, 133, 309; 248/285, 287, 298, 917-920

[56] References Cited

U.S. PATENT DOCUMENTS

| | | | |
|---|---|---|---|
| 4,410,159 | 10/1983 | McVicker et al. | 248/349 |
| 4,561,619 | 12/1985 | Robillard et al. | 248/285 |
| 4,575,033 | 3/1986 | Henneberg et al. | 248/185 |
| 4,648,574 | 3/1987 | Granlund | 248/285 X |
| 4,659,048 | 4/1987 | Fahrion | 248/285 |
| 4,716,438 | 12/1987 | Farrell | 355/200 X |
| 4,836,478 | 6/1989 | Sweere | 248/1 E |
| 4,887,128 | 12/1989 | Tamali et al. | 355/200 X |
| 4,965,635 | 10/1990 | Rushefsky | 355/202 X |
| 4,970,554 | 11/1990 | Rourke | 355/202 |
| 4,985,778 | 1/1991 | Ayata et al. | 355/202 X |

*Primary Examiner*—R. L. Moses

*Attorney, Agent, or Firm*—William A. Henry, II

[57] ABSTRACT

A printer for printing copy sheets includes a copy sheet path. The printer has an upper surface with at least one access panel vertically opening on the upper surface of the printer for sheet path access. The printer also has an operator control panel for controlling its functions. The operator control panel extends out over a portion of the upper surface of the printer overlying a copy sheet path access panel and extending towards the front of the printer for improved operator access to the operator control panel, with the operator control panel being laterally slidably mounted to the printer to be movable by the operator to a position not overlying the sheet path access panel for which opening is desired by the operator or indicated by the operator control panel.

11 Claims, 5 Drawing Sheets

PLURAL MODE PRINTER USER INTERFACE TERMINAL

This invention relates to printer apparatus or the like, and more particularly, to a repositionable User Interface Terminal for interfacing with such a printer.

An interactive user interface display and controller User Interface Terminal (UIT) using a cathode ray tube (CRT) or other technology provides, through the associated software, a substantially flexible, operable, and extensive interface to the user of complex equipment, such as printers, duplicators, computers and computer controlled machines. However, a problem with the use of interactive displays is that with machines that are large and spread out over a wide area, it is not convenient to work at the interactive display and at a particular part of the machine at the same time.

Obviously, to achieve maximum effective use of the interactive display's (UIT's) capabilities, it is best to locate the display as near to the point-of-use or area to be controlled as possible within ergonomic constraints. However, a problem arises when the UIT is positioned for easy programming by an operator, but in the way of access to, or beyond reach of certain areas of the machine onto which it is mounted. For example, if the UIT is positioned for easy programming by the user but is over an access panel for the paper path of the machine, an operator would be prevented from removing papers resulting from a jam under the panel, thus requiring a more complicated, time consuming and costly procedure to clear the jam.

Another problem with UITs as they are presently mounted on machines is the cumbersome and time consuming procedures required for service technicians where the technician must interact with the screen of the UIT for diagnostic purposes in order to repair the machine, i.e., running back and forth between his work location in back of or at one end of the machine with a UIT facing the front of the machine. Yet another problem with presently mounted UITs on printers is that due to the length of the printers one may have to walk back and forth from the UIT to the document handling and finishing stations of the printer in order to program document handling and finishing jobs.

Prior art includes U.S. Pat. No. 4,410,159, that shows an adjustable support for a display terminal providing a tilt of forty degrees and an infinite angle of swivel adjustment. In U.S. Pat. No. 4,561,619, a system for supporting and moving a CRT monitor on a horizontal surface is disclosed wherein the support is on rollers. The supporting means preferably also includes means for tilting and swiveling the monitor. U.S. Pat. No. 4,575,033, discloses a tilt-swivel base for a CRT terminal allowing the monitor to be rotated, swiveled and tilted readily. A semi-circular rocker drum is mounted on the underside of the terminal. The rocker drum is supported by a cradle which is inserted in a recess on a horizontal surface. The length of the recess is made longer than the length of the cradle thereby enabling the cradle to slide from side to side. A supporting device is shown in U.S. Pat. No. 4,659,048, for a data displaying unit, which is rotatable about a vertical axis and displaceable in a horizontal plane, allowing the distance between the eye and the display unit to be set for the viewing direction chosen by the operator. U.S. Pat. No. 4,836,478, discloses a suspension system for a monitor which allows rotation of the monitor around its vertical axis, and pivoting and tilting of the monitor. The monitor may also be moved laterally. These patents do not answer the problems heretofore mentioned with respect to positioning of CRTs on a printer.

There are prior methods of locating an interactive display at the point-of-use where the point-of-use may change depending on the particular function being performed. These may include replicated (additional) displays, reduced function point-of-use displays, and mechanical arms. Replicated displays will be excessively costly if the particular display technology itself is costly compared to the alternatives in providing the point-of-use capability. Reduced function point-of-use displays may lack sufficient user interface capabilities to achieve maximum capability or functionality of the controlled system.

Mechanical arms may address these problems through the use of a single display, but have inherent problems. Single arm supported displays may be limited in their ability to achieve ergonomically optimal placement as the display tracks on an arc of a circle. Articulated arms employing multiple pivot points, four bar linkages and the like can achieve great flexibility in display placement, but require precision parts and high strength to handle larger, heaver displays without appreciable wobble. Mechanical arms appear to use space that could be otherwise productive within the system or through less space for installation of the system. The swing arm mechanism and the heavy swinging object may present operator hazards.

Accordingly, disclosed herein is a printer for printing copy sheets that includes a copy sheet path. The printer has an upper surface with at least one access panel vertically opening on the upper surface of the printer for sheet path access. The printer also has an operator control panel (UIT) for controlling its functions. The operator control panel extends out over a portion of the upper surface of the printer overlying the at least one of the copy sheet path access panel and extending towards the front of the printer for improved operator access to the operator control panel, with the operator control panel being laterally slidably mounted to the printer to be movable by the operator to a position not overlying any one of the sheet path access panels for which opening is desired by the operator or indicated by the operator control panel.

The disclosed apparatus may be readily operated and controlled in a conventional manner with known or conventional copier or printer control systems, operated as taught herein. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with known software instructions for known microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers or printers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc.. The operator inputs and controls, and machine internal controls or limits, may be coordinated and/or made interactive with operator displays and "prompts" or instructions. E.g., U.S. Pat. No. 4,332,464 issued June 1, 1982 re the Xerox Corporation "5700" printer. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example(s) below, as well as the claims. Thus the present invention will be better understood from this description of an embodiment thereof, including the drawing figures (approximately to scale) wherein:

Describing now in further detail the exemplary embodiment with reference to the Figures, there is show a duplex printer reproducing machine 10 by way of one example of an apparatus in which the particular disclosed apparatus of the present invention may be utilized.

The following terms re the specific example here are hereby defined. "UI" is the User Interface, in this case the interactive CRT, or liquid crystal or other operator control console display panel and touch area or switch inputs connected to the system controller or ESS. It may also be called a UIT or User Interface Terminal. This UI is where document handling, or finisher or other machine functions or modes are programmed in by the operator. The disclosed system can be used to determine, for example which of the five document handling modes (Recirculating Document Handler (RDH), (Semi-Automatic Document Handler (SADH), Computer Forms Feeder (CFF), Platen, and Book copying) the operator is trying to use for scanning. E.g., document scanning in Book Mode or CFF Mode are "selected" by the operator at the UIT in this example. ESS is the Electronic Sub-System or system control. IIT is the Image Input Terminal, also called a scanner in this example, but it does more than just image scan here. (Another term for this is EFE or Electronic Front End). IOT is the Image Output Terminal, which writes or prints (with a laser beam) the marks on the (copy) paper. DH is the overall Document Handler, or feeder, also referred to hereinbelow as the "UDH" or universal document handler with both an RDH document stacking tray input and a SADH/CFF document input into which either computer form web (usually fan-fold) feeding (CFF) or large or other individual documents may be loaded and fed.

Figure 1:
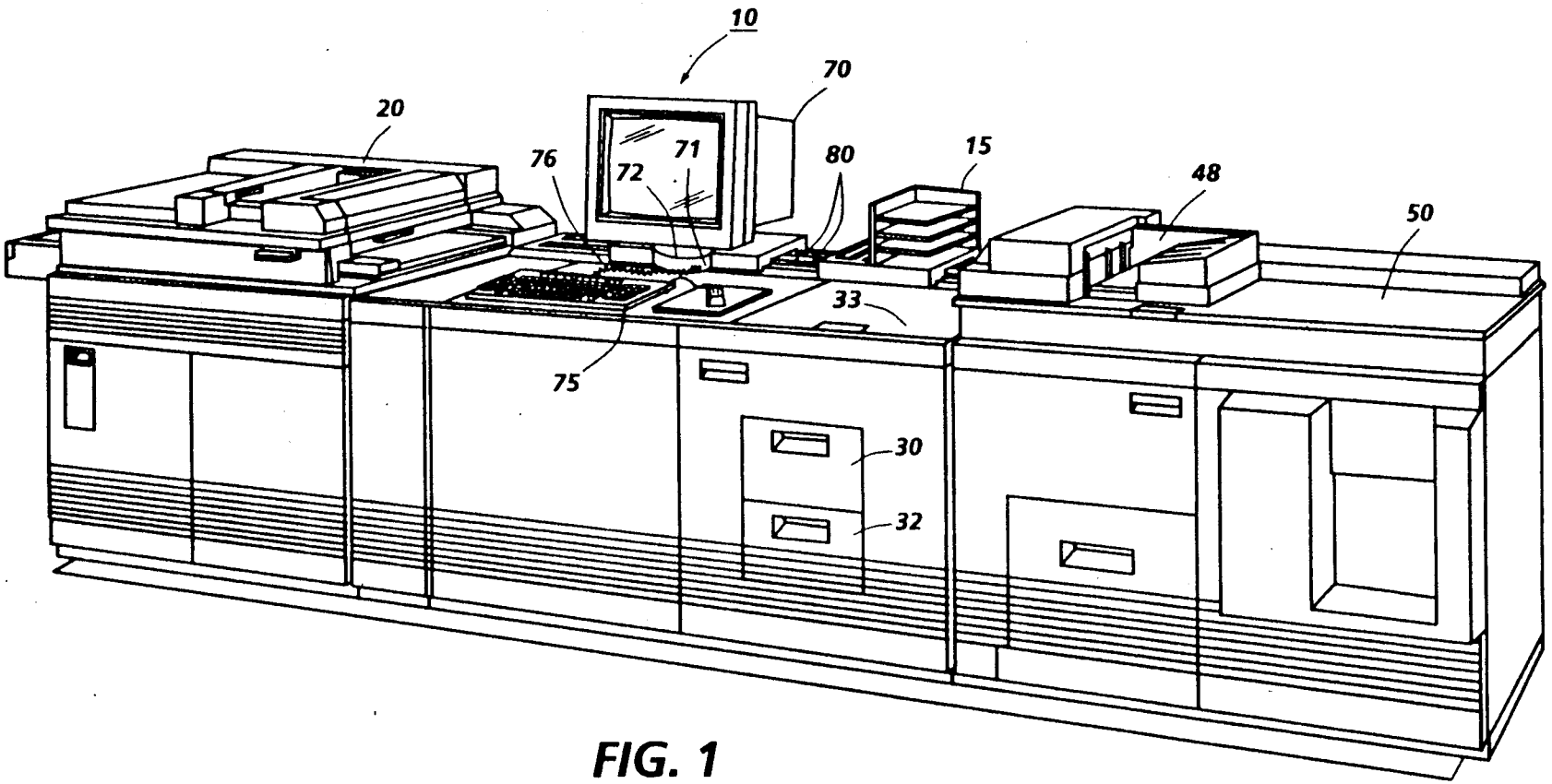
FIG. 1 is an isometric elevational view of one embodiment of a printer apparatus incorporating the present invention.
Figure 2B:
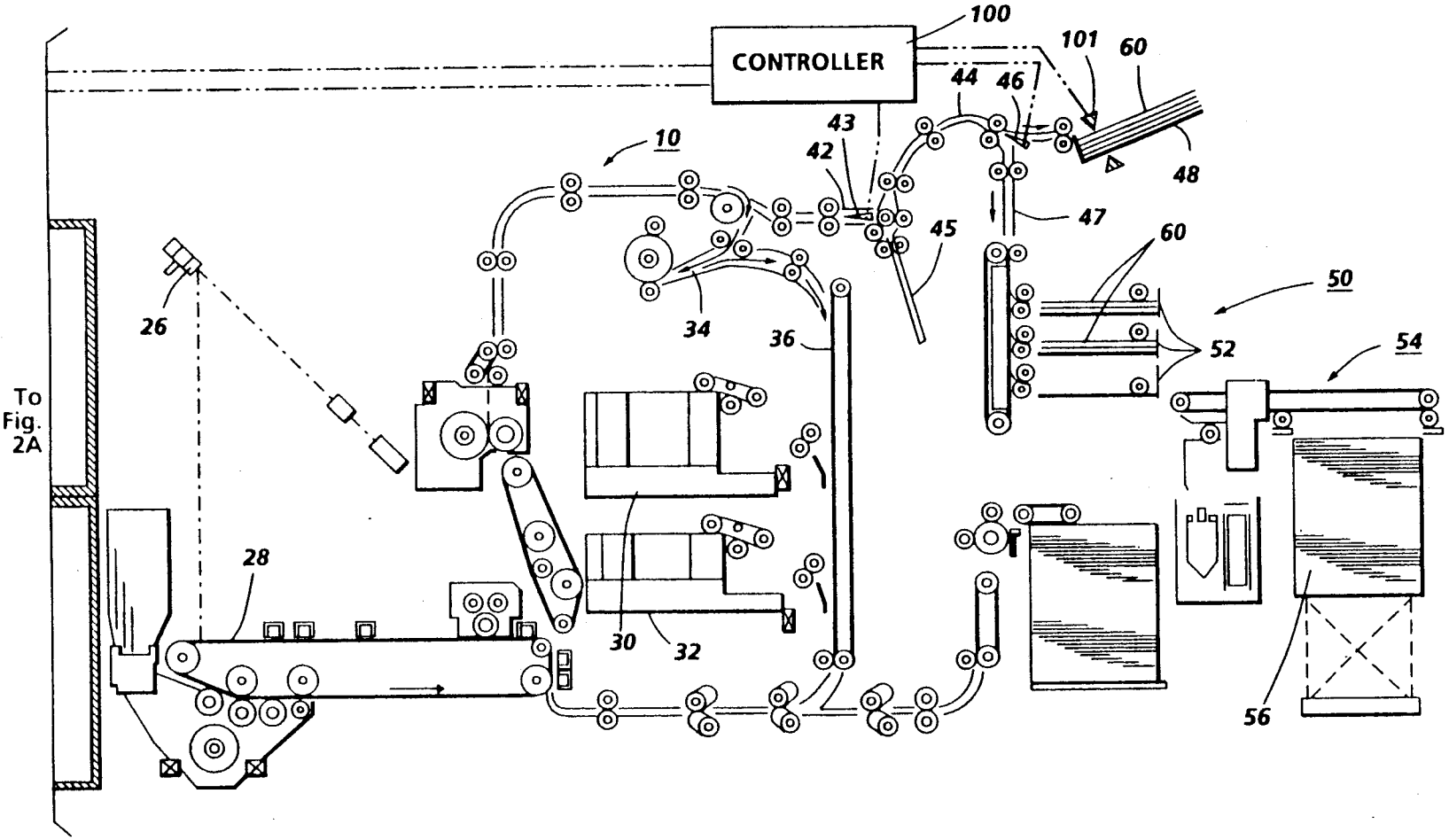
FIGS. 2A and 2B show a schematic partial side view of the printer apparatus of FIG. 1 incorporating one example of the subject system.
Figure 2A:
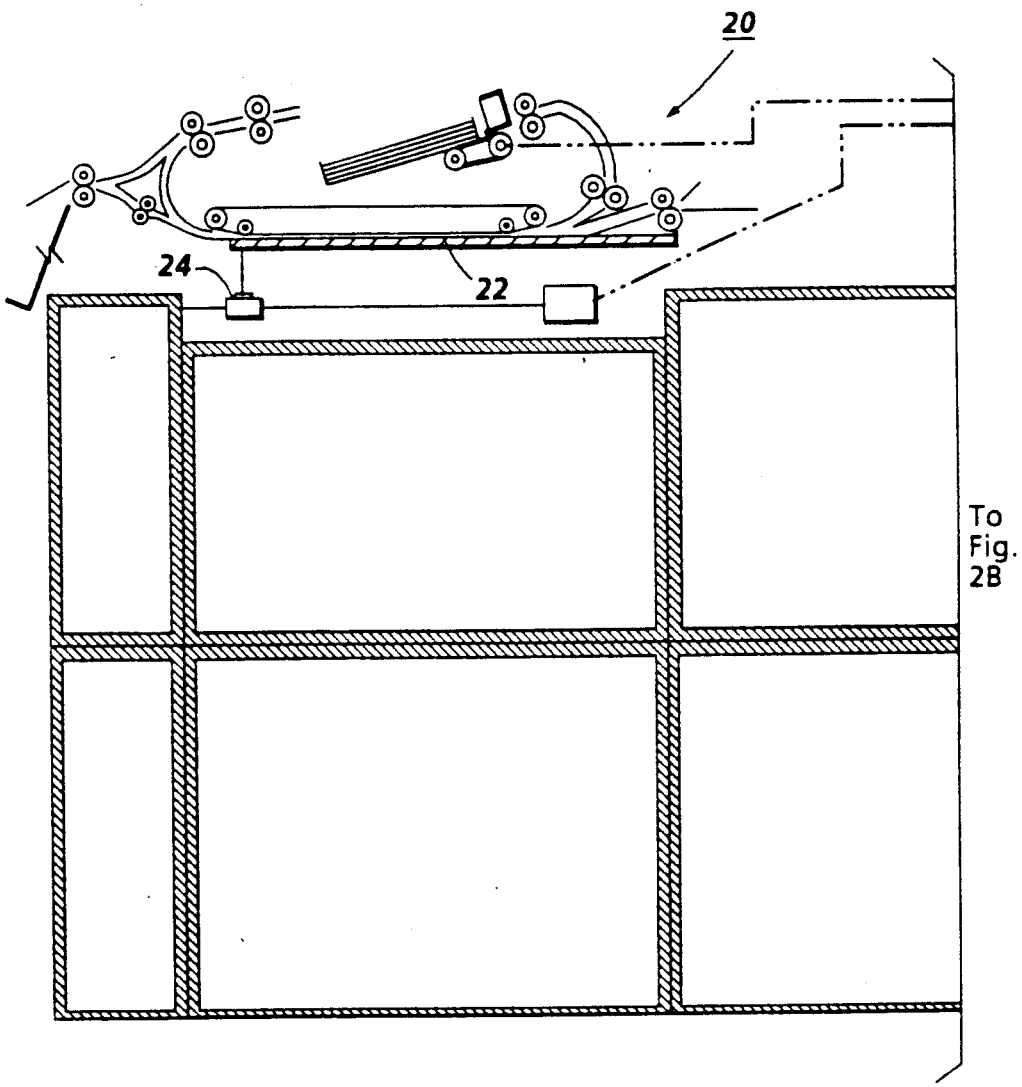

As disclosed in FIGS. 1, 2A and 2B, the printer 10 and its original document presentation system 20 in FIG. 2A may be like that disclosed in the above cited Xerox Corporation U.S. Pat. No. 4,782,363, issued Nov. 1, 1988 to J. E. Britt, et al (D/87203). An electronic document imaging system 24, and a laser scanning system 26 imaging a photoreceptor 28, may be provided as shown here and in the above cross-referenced applications. Alternatively this may be a conventional optical imaging system. As discussed above, operator inputs and controls and machine internal controls and operator displays and "prompts" or instructions are provided in a controller 100 with displays. The document handler may also be like that in Xerox Corporation U.S. Pat. No. 4,579,444, and the finisher disclosed herein is like that shown and described in Xerox Corporation U.S. Pat. No. 4,782,363, and its cross-referenced applications.

Here, in the printer 10 of FIG. 2B, a generally conventional xerographic system example is shown, with clean paper trays 30 and 32 feeding unimaged copy sheets through a paper path to be imaged at the transfer area of engagement with the photoreceptor 28. Then the copy sheets are fused and outputted sequentially via path 42. Alternatively, for duplex (two-sided) copies, the copy sheets may be diverted to an inverter 34, and returned via path 36 for second side imaging before being outputted via path 42. In the output path 42 a selectable deflector gate 43 may be provided to invert the copy sheets via an inverter 45 if gate 43 is actuated. Then the copy sheets pass on via path 44 to an output station selection gate 46.

If the sheet deflector gate 46 is selected by the operator (via controller 100 inputs and software) to be up, as shown, all copy sheets 60 after that are deflected into a finisher path 47 to the finisher 50 compiler trays 52, from which the completed copy sets are removed 54 and bound or stapled and output stacked 56. Alternatively, if the gate 46 is selected by the operator to be down, then all outputting copy sheets after that are deflected into a readily accessible top tray 48. The presence or absence of any sheets in that top tray 48 is sensed by a conventional optical or flag sensor 101 conventionally connecting with the controller 100.

Figure 3:
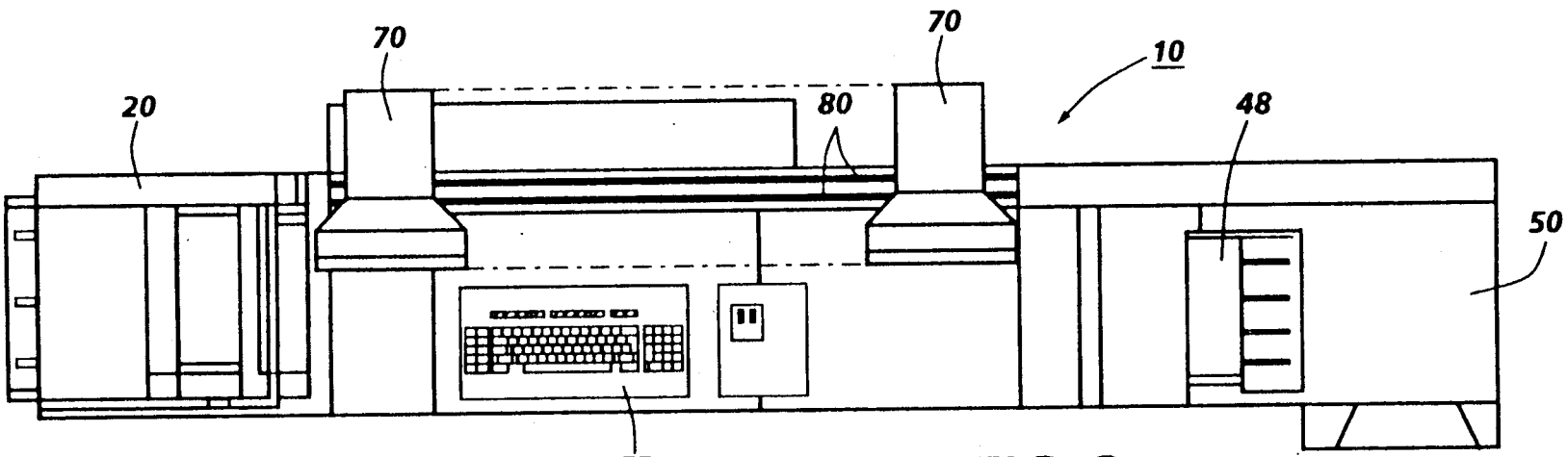
FIG. 3 is a partial plan view of the subject system of the present invention showing a User Interface Terminal at extreme lateral positions.

Printer 10 in FIG. 1 addresses problems encountered by casual operators as well as service technicians by mounting UIT 70 with conventional means as heretofore described in the prior art such that it is six-way positionable. UIT 70 is slidably mounted, e.g., on rollers, for lateral movement on tracks 80 by a light touch on base 71. An optional work organizer 15 is also slidable on the same tracks 80 for the convenience of the operator, in this example. This comprises trays in which documents or copies may be stored. With work organizer 15 removed, UIT 70 is slidable to the left as view in FIG. 1 to a position adjacent document handler 20 as shown in FIG. 3 for programming of document sets at the document handler and alternatively is slidable, to the right as shown in FIG. 3 and adjacent finisher 50 for reprogramming of copy sets based upon changing requirements. A flexible cord 76 is connected the UIT as well as to keyboard 75 to allow the lateral movement of the UIT while maintaining programming capability. The lateral movement shown is about 4'8" with an adjustment force of about 8 lbs.

Movement of UIT 70 also allows the operator to clear any paper jams that might occur in the paper path under cover 33. With the UIT moved over the processor section of the printer, one can raise cover 33 and clear the jammed area, replace the cover and continue the copy processing operation. This top access feature is particularly useful since it allows the operator to recover jammed copy sheets without bending down to do so.

Figure 4:
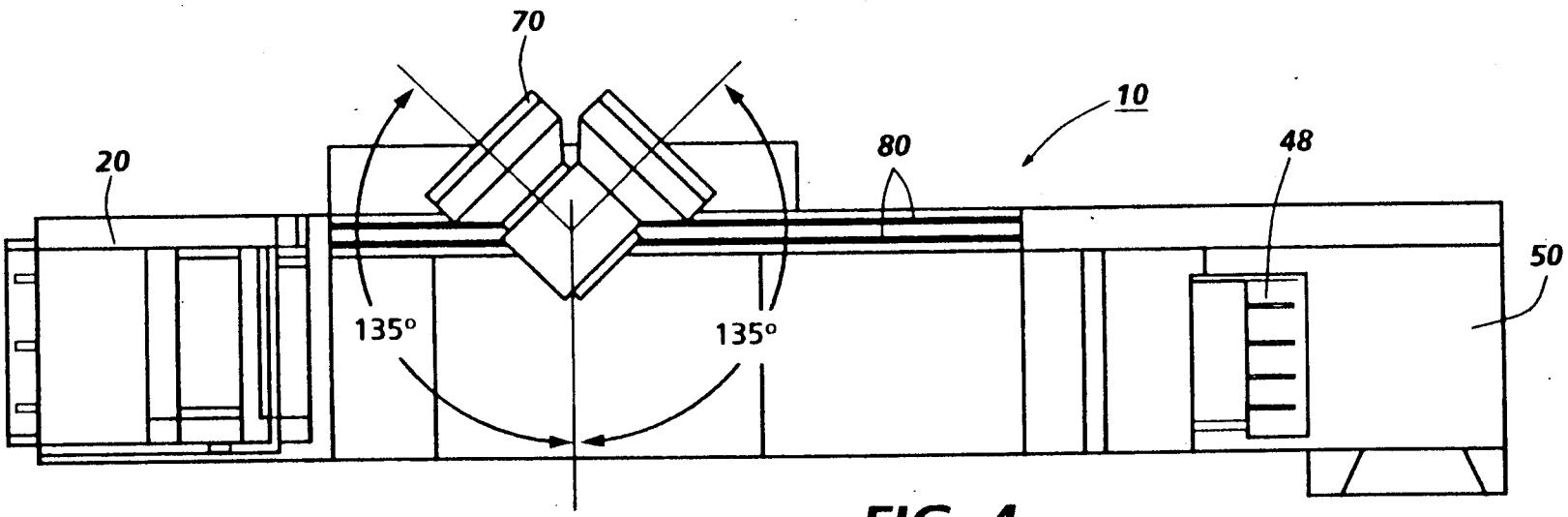
FIG. 4 is a partial plan view of the subject system of the present invention showing a User Interface Terminal at extreme swivel positions.

As shown in FIG. 4, UIT 70 is mounted by conventional means to swivel on base 71 along line 72 about 135 degrees left and right of a vertical plane through its center. The significance of this feature is that an operator has flexibility when programming in front of printer to move the UIT to a most advantageous swivel as well as lateral position for ease of programming. In addition, this feature affords a service technician the capability of swiveling the UIT to a position facing toward the component being repaired whether that is in the front or back of the printer. This is particularly useful as a diagnostics tool where the service technician is using the UIT to access a remote computer for answers to a problem, or for accessing a stored memory diagnostic routine in the printer itself. For example, if the service technician is in back of the printer the UIT can be moved laterally to the position of the component being worked on and swiveled to face the technician. With this being done and the UIT accessed, the technician can use both hands to adjust the printer while reading instructions from the screen of the UIT. Also, the screen face of UIT 70 is within arms reach of the operator for entering diagnostic or other commands there while observing and/or adjusting the hardware with the other hand.

Figure 5:
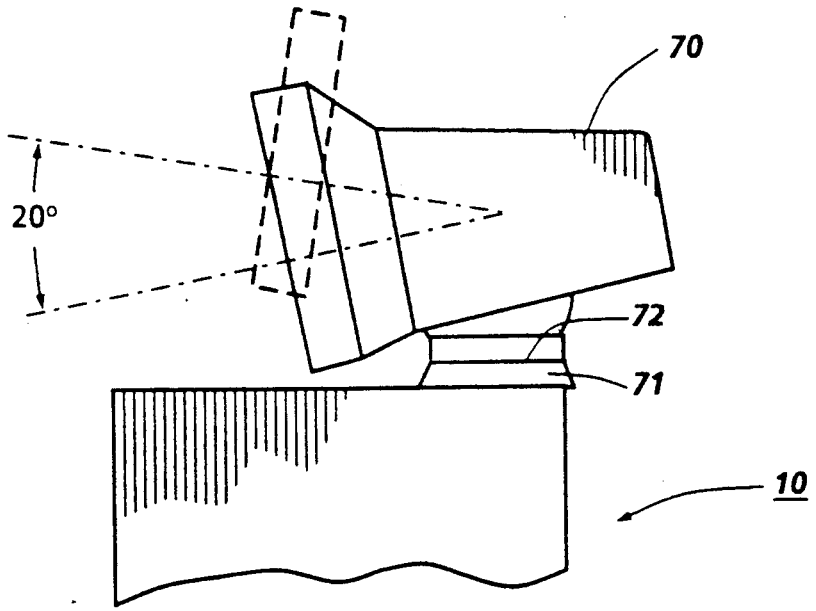
FIG. 5 is a partial end view of the subject system of the present invention showing a User Interface Terminal at extreme tiltable positions.

A further feature of this system that is useful to both the casual operator and the service technician is shown in FIG. 5. It includes UIT 70 being conventionally mounted for tiltability by about 20 degrees. With this feature, the UIT can be adjusted up or down to suit a particular operator's height and adjusted by a service technician for ease of reading while the technician is working on the printer below the level of the UIT. The UIT can also be completely removed from the printer and mounted on a pedestal, if desired.

It should now be apparent that a system has been disclosed for use with a large or detached machine system installation that includes the use of a "positionable" User Interface Terminal which allows the user (operator/service technician) to move the UIT to closely adjacent and facing the point-of-function or operation, where otherwise the system operability may be cumbersome or difficult.

While the embodiment disclosed herein is preferred, it will be appreciated from this teaching that various alternatives, modifications, variations or improvements therein may be made by those skilled in the art, which are intended to be encompassed by the following claims:

What is claimed is:

1. A printer for printing copy sheets, with a copy sheet path, said printer having an upper surface with plural access panels vertically opening on said upper surface of said printer for sheet path access, further including an operator control panel for controlling said printer, which operator control panel extends out over a portion of said upper surface of said printer overlying at least one of said copy sheet path access panels and extending towards the front of said printer for improved operator access to said operator control panel, said operator control panel being laterally slidably mounted to said printer to be movable by the operator to a position not overlying any one said sheet path access panel for which opening is desired by the operator or indicated by said operator control panel.

2. The printer of claim 1, wherein a portion of said upper surface of said printer also is occupied by a vertically pivotable automatic original document feeder and said operator control panel is also movable closely adjacent to or away from said automatic original document feeder.

3. The printer of claim 1, wherein said operator control panel comprises a video display and operator input selector module mechanically operator slidable along a track extending along substantially said entire printer upper surface adjacent the rear thereof.

4. The printer of claim 1, wherein said operator control panel comprises a touch control UIT video display.

5. A printer for printing copy sheets, including internal operation portions accessible to personnel who operate or service said printer, said printer having an upper surface with at least one access panel vertically opening on said upper surface of said printer for access to said internal operation portions, further including an operator control console for controlling said printer, which operator control console extends out over a portion of said upper surface of said printer overlying said access panel and extending towards a front portion of said printer for improved operator access to said operator control console, said operator control console being mounted on said printer to be movable by the operator or service personnel to a position not overlying said access panel for which opening is desired or indicated by said operator control console.

6. A printer for printing copy sheets from document images, with a connecting operator programmable interactive control panel for programmably controlling said printer, said printer also including both an operator programmable document imaging input section with plural programming options and an operator programmable output finishing section for said copy sheets with plural programming options, which output finishing section is substantially remote from said document imaging input section; wherein said operator programmable interactive control panel is a single control panel which is movably mounted relative to said printer to be movable by the operator to a position closely adjacent to said document imaging input section and is also movable by the operator to a position closely adjacent to said output finishing section, so that the operator can program said document imaging input section with said control panel moved closely adjacent thereto, and program said output finishing section with said same control panel moved closely adjacent thereto.

7. The printer of claim 6, wherein said document imaging input section comprises an automatic original document sheet feeder and an associated document sheet scanner, and wherein said operator control panel is so movable directly adjacent to said automatic original document feeder.

8. The printer of claim 6, wherein said operator control panel comprises a video display and operator input selector module mechanically operator slidable along a track extending along substantially said entire printer upper surface adjacent the rear thereof.

9. The printer of claim 8, wherein said operator control panel comprises a touch control UIT video display.

10. A system for clearing the paper path of a machine, comprising: top access door on said machine covering said paper path; a UIT in an original position extending over said access door toward the front of said machine for operator interfacing that is laterally slidable to a position removed from said access door so that said access door can be lifted and paper removed from said paper path as required.

11. The system of claim 10, wherein said UIT is rotatable to a position facing an operator.

* * * * *